United States Patent [19]

Young et al.

[11] 4,069,643

[45] * Jan. 24, 1978

[54] APPARATUS AND METHOD OF PACKAGING LARGE ITEMS

[75] Inventors: William E. Young, Atlantic Highlands; Robert O. Wolfelsperger, Fairfield; William R. Pasco, Cream Ridge, all of N.J.

[73] Assignee: William E. Young, Atlantic Highlands, N.J.

[ * ] Notice: The portion of the term of this patent subsequent to May 24, 1994, has been disclaimed.

[21] Appl. No.: 791,644

[22] Filed: Apr. 27, 1977

[51] Int. Cl.[2] ..... B65B 31/02; B65B 9/02

[52] U.S. Cl. ..... 53/22 A; 53/28; 53/86; 53/112 A; 53/182 R

[58] Field of Search ..... 53/22 A, 22 B, 28, 86, 53/95, 112 A, 112 B, 182, 373

[56] References Cited

U.S. PATENT DOCUMENTS 4,024,692 5/1977 Young et al. ..... 53/22 A

*Primary Examiner*—Travis S. McGehee
*Attorney, Agent, or Firm*—Ralph R. Roberts

[57] ABSTRACT

This invention discloses a packaging apparatus and method for large size products such as subprimals of meat. The products to be packaged are characterized as often having irregular surfaces and voids which make sealing of the film without wrinkles very difficult, particularly after bringing to a condition of reduced pressure. There is shown apparatus for forming a drape of film from two rolls of film and into this drape of film is advanced the product to be packaged. This drape is formed into a tubular film around the product and with this tube open at both ends. Into these open ends of the tube are moved spreader probes or bars which operate as pairs and are moved away from one another by a pneumatic cylinder which is actuated by appropriate apparatus so that the spreader probes as they move apart cause the film in these ends to be brought to a narrow opening and under a slight stretch. This elongated opening is substantially equally spaced from a theoretical center line of the tubular film. With the probes moved to a condition for stretching the film, the encased product and film are brought in way of a film heater and then are moved to a vacuum chamber whereat the spreader probes are withdrawn from the ends of the package. While and when in this chamber the interior and product are brought to a condition of reduced pressure. While still in the chamber and under the influence of reduced pressure, the elongated ends of the tubular film are heated and sealed so that these ends of film are substantially free of wrinkles. After sealing and with the ends still clamped, the chamber is opened to the atmosphere to allow the film ends to tightly enclose the product. The package is then removed from the vacuum chamber. Large products when packaged by skin packaging apparatus tend to have the film overstretched. This occurs when the product is used to shape and mold a heated film. With the product pushed into the draped film and a tube formed by closing and sealing the rear of the drape, overstretching of the film is eliminated or minimized to tolerable levels so that the resulting package is absent weak portions of film.

10 Claims, 29 Drawing Figures

291
292
205
287
286
3a
3b
3c
259
267
265
148
283
279
263
150
241
278
285
281
276
221
219
211

APPARATUS AND METHOD OF PACKAGING LARGE ITEMS

CROSS REFERENCE TO RELATED APPLICATIONS

This application is closely related to our Application Ser. No. 658,991, filed on Feb. 18, 1976. This application shows the addition of film heating and the retaining closed of the ends of the package after opening of the vacuum chamber to atmosphere. A terminal disclaimer is being filed with this application so that this application is coextensive with the allowed application Ser. No. 658,991.

BACKGROUND OF THE INVENTION

1. Field of the Invention

With reference to the classification of art as established in the United States Patent and Trademark Office the present invention is believed to be found in the general Class entitled, "Package Making" (Class 53) and in the subclasses thereunder entitled, "methods-with contents treating-vacuum or gas receptacle forming" (subclass 22A) and "with contents material treating-vacuum or inert atmosphere — includes container forming" (subclass 112A).

2. Description of the Prior Art

The apparatus, the method of vacuum forming and packages formed while in a vacuum chamber are all well known. Film packaging of food products is particularly a well known and crowded art since todays fresh meat, produce and many frozen products are delivered to the stores in an already film packaged state. Toward that end and to the extent applicable to this type of package, reference is made to U.S. Pat. No. 3,491,504 as issued to W. E. YOUNG, etal. on Jan. 27, 1970 and to U.S. Pat. No. 3,686,822 as issued to WOLFELSPERGER on Aug. 29, 1972. In these and many other patents warmed film is drawn to and around the product by the influence of atmosphere as and after the package and contents have been brought to a condition of reduced pressure while in a vacuum chamber. In these patents and in other apparatus the sealing occurs within the chamber. In many skin packages the film material is stretched to the point where it loses its barrier properties which protect the product from moisture losses and from oxygen. Automatic skin packaging of many products, therefore, is often less than satisfactory in producing sound packages.

In the present invention the problem or excess film, that is film which is not utilized in encasing the product, is solved by providing a double ended bag. After the product is positioned in the tubular film member, a pair of spreader probes is moved by pneumatic means away from each other to cause a narrow elongated opening to be formed at and in each end of the tubular film. These probes enter both ends of the tubular film. The spreader probes, as they move apart, lightly stretch each end opening and more-or-less center the openings with the center line of the tubular film. The film is heated while the product encased in the tubular film is transported to a vacuum chamber and the apart spreader probes are maintained in the tubular film. Prior to closing and evacuating the vacuum chamber, the pair of spreader probes are withdrawn directly outward in order to maintain the elongated opening at each end of the film. This stretch maintains the opening while the chamber is closed and brought to a condition of reduced pressure.

After the desired amount of reduced pressure is achieved, the elongated end portions of the film are sealed by sealing bar means. The ends of the film are heated by local heaters within the chamber and these ends may or may not remain clamped during venting of the chamber. The chamber is then opened to atmospheric pressure and the vacuum packaged and sealed product is removed from the vacuum chamber. A pressure differential across the packaging film causes the heated film to be stretched and formed about the end of the product.

SUMMARY OF THE INVENTION

This invention may be summarized at least in part with reference to its objects.

It is an object of this invention to provide, and it does provide, an apparatus for encasing a product in a tubular film. Into each of the open ends of the tubular film a pair of spreader probes is inserted and the spreader probes are moved apart to cause the open ends of the tubular film to be formed into elongated narrow openings. While in this condition the package is transported in way of a film heating device and then into a vacuum chamber wherein it is brought to a condition of reduced pressure and the ends of the film are sealed substantially free of wrinkles.

It is another object of this invention to provide, and it does provide, a method of encasing a product in a tubular film and while the product is in this tubular wrapping a pair of spreader probes is inserted into each end of the tubular film to a point near the product. The spreader probes move outwardly to bring each end of the tubular film into an elongated, slightly stretched, narrow opening condition. While in this condition, the package is moved in way of a film heating device and then to a vacuum chamber whereat the probes are withdrawn from the film. The chamber is then closed and brought to a condition of reduced pressure. While in the chamber and under the influence of reduced pressure the ends of the film are heated and clamped and the ends remain clamped while and when the chamber is vented and with the ends sealed the chamber is opened. The vacuum packaged product is then removed.

In brief, the apparatus of this invention provides for the forming of a drape of film preferably from above and below rolls of film which are joined at the product transport apparatus. The product to be wrapped is pushed into this drape. After a determined amount of advancement of the product into the drape is achieved, the product is stopped and the film trailing the product is sealed and cut to form a tubular bag around the product, the bag being open at both ends. Prior to or after completing the seal, into each of the open ends of the wrap is inserted a pair of spreader probes actuated by pneumatic cylinders. The spreader probes, as they are moved apart, lightly stretch each end opening causing the film ends to be formed into narrow openings under a determined stretch force. With the spreader probes still inserted into the ends of the tubular film, the encased product is moved in way of a film heating device and then to a vacuum chamber whereat both pairs of spreader probes are removed prior to the chamber being closed. The chamber and product are then brought to a condition of reduced pressure. While still in the chamber and under this condition of reduced pressure, the elongated ends of the film are locally heated by means in the chamber and along the previously established parallel extents are sealed together with the ends being substantially free of wrinkles. As and while the ends are still clamped, the chamber is opened to atmosphere and the vacuum sealed package is removed. In this apparatus and by this method the product, when packaged, does not overstretch the film in which it is encased. This condition of overstretching usually occurs when large products are packaged by skin packaging apparatus using the product to shape and form a film. The stretching of the film actually comes about by the pressure differential across the film. The primary purposes of adding the heat in this system are to:

a. cause the sealant coatings on the inner surfaces of the laminations being used to stick or bond to each other wherever they come in contact. There is a wide flange left on the side of these packages. This flange may be 2, 3 or 4 inches wide, and if the two films do not bond to each other in this area, the juices in the product, after a period of time, tend to weep out into this space even though there is a pressure differential across the two faces of the film holding them tightly together. If these films are not actually sealed, there is produced a weeping of juices into this area making the package look rather unsightly. Therefore, the addition of the heat allows this film to be sealed to itself from the edge of the product out to the heat seal. In existing apparatus the package comes out of a vacuum chamber and is delivered to a shrink tunnel. In this method the package is placed on a conveyor, and goes through the heated tunnel. The pressure differential across this film with the addition of heat causes the flanges to have their sealant coatings stick to each other, thereby forming not a complete hermetic seal all the way from the edge of the product out to the seal line made by a seal bar inside the vacuum chamber, but a reasonably tight seal.

b. a holding of the package end tightly clamped with the seal bar, and when the pressure differential is applied across the film (the atmospheric pressure on the outside and the vacuum on the inside) it causes the film to form about the ends of the product. This produces a package somewhat similar to the skin package which is a cross between a bag and a skin package.

The apparatus and method of this invention provide a unique packaged product. It is known to utilize a bag with an open end into which a product, often poultry, is placed and with a snorkel the bag is partly evacuated. A tie is used to close this end of the bag. It is also known to utilize a bag to enclose a product and to seal the open end with a heat seal. Such a package usually requires hand smoothing of the wrap to make it presentable and substantially free of wrinkles.

There are other disadvantages of using a bag that this present invention overcomes. A disadvantage of a bag is that the product must be slid through the mouth of the bag which sometimes causes the mouth of the bag to be contaminated from the product sliding by, for example, sometimes pieces of product adhere to the mouth of the bag. A seal produced in this contaminated area is sometimes a source of leakage in the final package. In this invention the seal portions are never exposed to the product. In other words, the film is wrapped about the product in a tube and the portion of the film that is to be sealed is never in contact with the product. Still another disadvantage of using bags that is encountered is trying to insert the product into a bag. The operator generally selects a bag that is much larger in circumference and larger than what is required because when one views a lay, flat bag and looks at the product to be encased it is rather difficult to determine just what size bag would be required for the specific product. Since products to be packaged differ greatly in size, one must continually select the proper bag for each individual product. Usually an operator selects a larger and a longer bag than is required for the product, thereby, utilizing excessive film for the packaging operation. In this invention a tube of film is wrapped tightly about each product regardless of what the girth of the product may be. In this invention a limitation is that more film is used in the web width than with the bags because only one web width at a time is employed. However, since the width is the shorter of the dimensions the total film consumption is considerably less than that in bags.

In the present invention the package when brought to a condition of reduced pressure presents a unique method and product. Both ends of the film bag are open and after the spreader probes stretch each to a determined open condition the bag is closed by sealing bars. This results in a smooth package with the very minimum of wrinkles and surplus film around the product even in the absence of vacuum.

In addition to the above summary the following disclosure is detailed to insure adequancy and aid in understanding of the invention. This disclosure, however, is not intended to prejudice that purpose of a patent which is to cover each new inventive concept therein no matter how it may later be disguised by variations in form or additions of further improvements. For this reason there has been chosen a specific embodiment of the vacuum packaging apparatus as adopted for use with large products and showing a preferred means for forming elongated openings at each end of a tubular film. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names, however, are intended to be generic in their application. Corresponding reference characters refer to like members throughout the several figures of the drawings.

The drawings accompanying this specification disclose certain details of construction for the purpose of explanation but it should be understood that structural details may be modified in various respects without departure from the concept of the invention and that the invention may be incorporated in other structural forms than shown.

Figure 1:
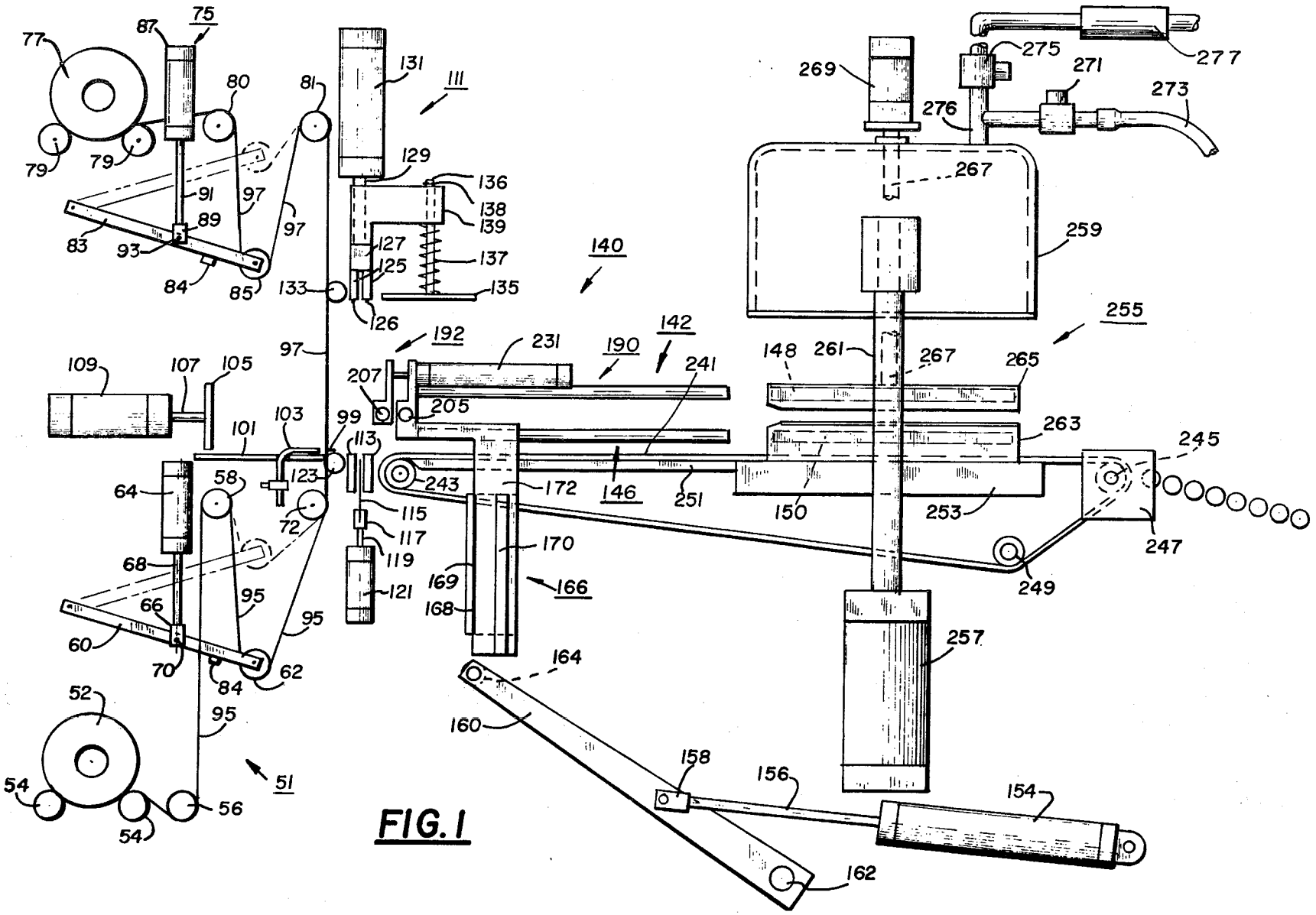
FIG. 1 represents a schematic side view of the wrapping and sealing apparatus prior to the presentation and insertion of the product into a formed drape of film.
Figure 2:
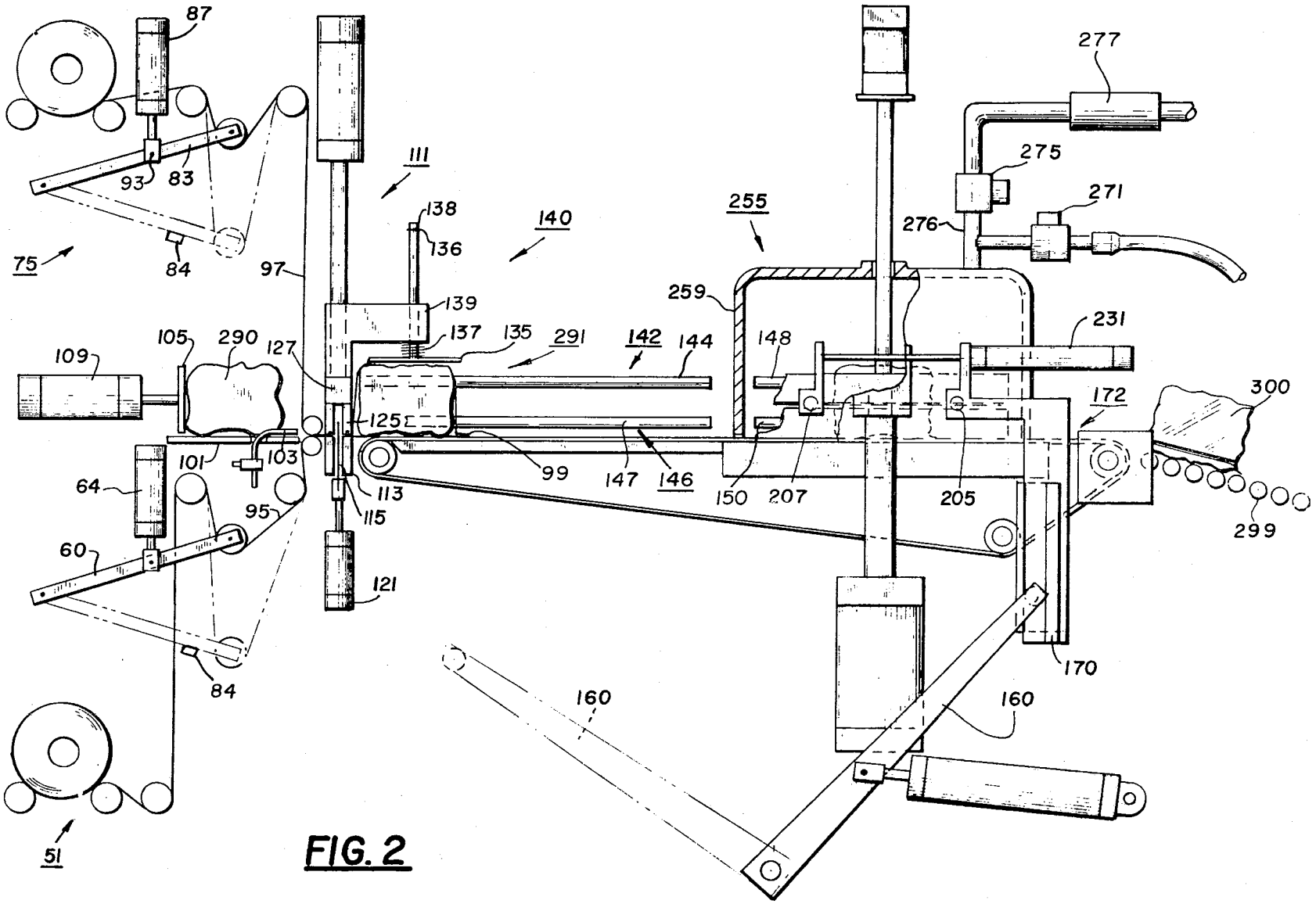
FIG. 2 represents a schematic side view of the apparatus as shown in FIG. 1 with the product shown in various positions of the package forming and sealing operation.

DESCRIPTION OF THE PREFERRED EMBODIMENT OF THE FILM DRAPE AND TRANSFER APPARATUS OF FIGS. 1 AND 2

Referring to the diagrammatic views of the film drape and article transfer apparatus of FIGS. 1 and 2, there is shown a lower web film feeding supply apparatus generally identified as 51. The lower film supply includes a roll of film 52 resting on a pair of cradle rollers 54 and from this roll the film leads to a first guide roller 56 and thence to and over a second guide roller 58. A pair of dancer arms 60 is pivotally carried by the frame and between the ends of these arms is a freely rotating dancer roller 62 which receives the film from the second roller 58. An actuator in the form of a pneumatic cylinder 64 carries a clevis 66 which is mounted on the end of piston rod 68 of the cylinder 64. A pivot pin 70 connects the dancer arms 60 to the clevis end 66. A deflector roller 72 provides the positioning on the lower extent of film as it is brought to a joining location with the upper film.

The upper film and feeding apparatus is generally identified as 75. Included in this apparatus, which is substantially a mirror arrangement of the bottom film supply, is upper film supply roll 77 which rests upon a pair of cradle rollers 79. The output of this roll is lead to and partly around a first guide roller 80 and then to and partly around a guide roller 81. A pair of dancer arms 83 is pivotally carried by a support frame and these arms are limited in their downward movement by stop 84. A dance roll 85 also engages this film and is carried between and by the arms which are moved by the dancer arm pneumatic cylinder 87. A clevis 89 is carried on the end of a piston rod 91 of cylinder 87. A pivot pin 93 secures the dancer arm 83 to the clevis member 89.

In operation, the lower web of film is brought to a joining location with the upper film to provide a drape or curtain. The path of the lower web of film as it is lead over the several rollers is shown by the solid line 95. The path of the upper web of film is shown by the solid line 97. The two webs are joined at seam 99 to provide a drape or curtain of film which is in way of the path of the product to be wrapped.

Referring still to FIG. 1, there is depicted a product support member 101 shown at the left of the film seam 99. An air jet nozzle 103 as carried by the machine frame is shown. A nozzle is disposed on each side of the product support 101 and this nozzle is more-or-less in line with or near the edges of the webs of film 95 and 97. The jets, when actuated, direct streams of pressurized air toward and into the drape of film to cause it to move downstream and encourages the ends to remain in an open condition. In certain apparatus the use of a jet stream has been supplanted by a mechanical former. A product pusher member 105 is secured to the end of a piston rod 107 of a cylinder 109 which is carried by appropriate support means. When cylinder 109 is actuated the product is pushed into the curtain or drape of film.

Still referring to FIG. 1, a seam sealing station generally identified as 111 is provided with a pair of lower seal bars 113 which are held in a determined spaced relationship so that a knife 115 is slidable therebetween. These lower seal bars 113 are fixed to a suitable support or can be moved by an actuator means carried by the apparatus frame. The knife 115 is mounted in a clevis means 117 fastened to and carried at the end of a piston rod 119 of a knife actuating cylinder 121. A guide roller 123 is mounted to one of the lower seal bars so as to support and guide the drape of film as it is moved forwardly during the film wrap of the product and or by the blast from the jet nozzles 103.

A pair of spaced upper seal bars 125, each having sealing strips 126, is spaced and mounted so as to move into cooperative sealing relationship with the lower seal bars 113. These upper seal bars are mounted in and are carried by a support member 127 which is secured to and carried by the end of a piston rod 129 of an upper seal bar cylinder 131. The cylinder 131 is fastened to a frame portion of the apparatus. A guide roller 133 is mounted to and is carried by one of the upper seal bars and provides a change of direction for the upper film as it guides the drape of film as it is moved forwardly by the advancement of the product or blast of air. A pressure pad or plate 135 is mounted on a shaft 136 which also carries a compression spring 137. The upper end of the shaft carries a retaining ring 138 which limits the downward movement of the shaft 136. This shaft is journaled for longitudinal movement in block 139 which is mounted on support member 127. The movable pressure pad 135 is urged downwardly by the compression spring 137 and is limited in this downward movement by the retaining ring 138 which is above member 139.

In FIGS. 1 and 2, a package transfer station is indicated as 140. A fuller and more detailed explanation is found in the reference application and in particular in the drawings and discussion of FIGS. 3 and 4 of that application. Between this package transfer station 140 (FIGS. 1 and 2) and a vacuum chamber 259. later described, there is provided upper radiant heater apparatus 142 having elements 144 combined with a lower heater apparatus 146 having elements 147 to soften the upper and lower films as they are moved toward the chamber. This softening enables the films to be drawn more tightly around the product without a weakening or tearing of the film as it is sealed.

Although more fully discussed in the reference application, there is shown in FIGS. 1 and 2 a piston rod 156. Cylinder 154 which moves the rod is shown in the extended condition and on the rod end is attached pivot block 158. Cam arm 160 is pivotally mounted by pin 162 to the frame and is moved by the actuation of cylinder 154. Piston rod 156 which is affixed to the pivot block 158 is pivotally connected to the cam arm 160. A cam follower 164 which is an antifriction bearing is rotatably carried at the swinging end of cam arm 160 and is sized to slidably fit in a cam track 166 during portions of the film and package transfer cycle. This cam track 166, as constructed, includes a short front member 168 which is maintained a spaced and determined distance from a longer rear member 170. The long rear cam track member 170 is fixedly mounted to a side plate 172.

As seen in FIGS. 1 and 2, a spreader probe or bar 205 is slidably journaled and carried by near side plate 172 and an oppositely disposed probe 205 is journaled and carried in a far side member. Companion spreader probes or bars 207 are slidably journaled in a bearing pedestal carried by a plate member on the near side and in a mirror arrangement on the far side. The operation and apparatus for the moving of the probes together and apart as well as the transporting of the wrapped package to a vacuum chamber is shown and described in detail in the above referenced application.

Referring still to FIGS. 1 and 2, a conveyor belt 241 is supported at one end by a freely turning roller 243 and at the delivery end of the machine by a drive roller 245. An idler roller 249 is positioned below and intermediate the front and drive rollers 243 and 245. The upper extent of the belt 241 is supported by a stationary plate 251 at the foreportion and at the rear portion by a final seal station mounting plate 253.

Referring yet to FIGS. 1 and 2, an end seal station, generally identified as 255, includes seal station mounting plate 253 and upper vacuum chamber actuating cylinder 257 which is carried by the mounting plate 253. An upper vacuum chamber 259 is fastened to piston rod 261 of the cylinder 257 and is raised and lowered by the actuation of the cylinder. A lower seal bar 263 is mounted to and carried by the mounting plate 253. An upper seal bar 265 is secured to and carried by a piston rod 267 of a seal bar actuating cylinder 269. The seal bar cylinder 269 is fastened to and carried by the machine frame while the piston rod 267 is journaled in the upper vacuum chamber 259. A pair of valves control the interior of the closed chamber. A valve 271 controls the flow in conductor 273 which leads to a source of vacuum. A second valve 275 is ported to atmosphere. A conductor or pipe 276 carries the vacuum or atmosphere to the interior of the closed chamber.

If desired, the wrapped package in addition to being heated with the upper film heating apparatus may also have a lower heating apparatus 146. These upper and lower units 142 and 146 warm the film around the product sufficiently for the film portions 95 and 97 to more tightly enclose the product when and while in the vacuum chamber. In addition to the outside heaters 142 and 146 air to the vacuum chamber 259 and through the valve 275 may first pass through a heater 277 by which and through which the incoming air as heated air is fed to the inside of the chamber 259 when vacuum is cut off and the chamber is opened to atmospheric pressure.

Warming the film around the product sufficiently for the film portions to more tightly enclose the product when and while in the vacuum chamber results in the sealing off of the web or ears that extends beyond the product. It is contemplated to soften up the sealant coatings on these films so that they will stick to each other. In some instances, a completely non-supported material such as polyethylene or Surlyn (Trademark of E. I. DuPont) for a packaging film may be used, and in these instances the films will be softened and actually stick to each other. The way this package is produced, it is possible that the top web, for example, may be folded on itself and will be sticking to itself. It is not only a case of the top web bonding to the lower web, but actually whatever makes up the bottom and lower half of the package when the tube is stretched by the spreader fingers, the upper side is bonded to the film that is on the lower side, whether it be the upper or lower web per se.

SEQUENCE SHOWN IN FIGS. 3*a* THROUGH 3*f*

Referring next to the sequence of package forming and sealing as shown in the partial sectional views in FIGS. 3*a*, 3*b*, 3*c*, 3*d*, 3*e* and 3*f*, there is depicted in enlarged scale the upper chamber 259 which with the mounting plate 253 forms the chamber. A gasket 278 is carried on the downwardly extending edge of the upper portion of the vacuum chamber 259 so that when and while in the closed condition of FIGS. 3*c*, 3*d* and 3*e* the chamber is sealed to the flow of gases except through pipe inlet conductor 276. The lower seal bar 263 has a resilient insert 279 which insert is more-or-less centrally positioned in member 263. A downwardly directed package mouth support 281 is secured to and carried by bar 263. The upper seal bar 265 is contemplated to be made of insulating material and intermediate its width and on the bottom surface thereof is a film sealing means 283 which may be a resistance ribbon. A plow member 285 is hinged to the upper seal bar 265 and is urged to and toward the shown downward position of FIG. 3*a* by a leaf spring 287. Within the chamber 259 there is disposed local heating units adapted to warm the ends of the package as and while they are sealed. Heater unit 150 is carried by and adjacent the lower seal bar 263. Heater unit 148 is carried by and adjacent the upper seal bar 265. As the chamber and seal bar 265 move upwardly, the heater unit also is carried upwardly.

OPERATION OF THE PREFERRED APPARATUS

Figure 16:
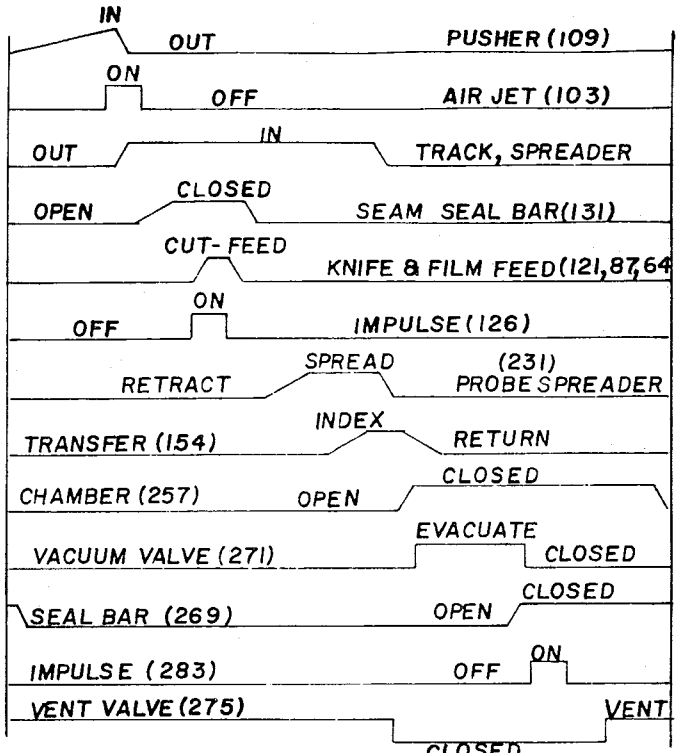
FIG. 16 represents a timing cycle diagram for one machine cycle to form a complete package around a product showing the preferred apparatus.
Figure 17:
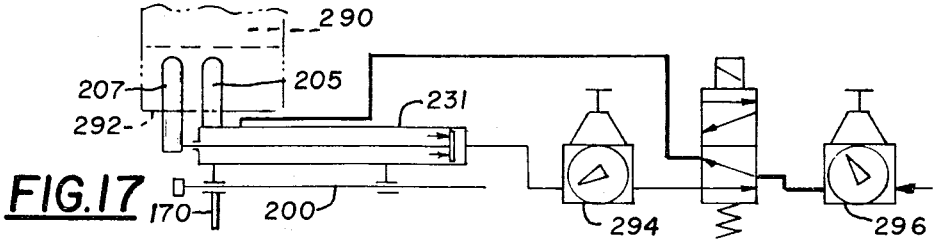
FIG. 17 represents a schematic view depicting the spreader probes and the associated control components such as a solenoid valve and pressure regulators by which equal apart pressure on the film is applied to each of the probes.

As above shown in FIGS. 1 and 2 and also as shown in the timing diagram of FIG. 16, initially a seam 99 is made joining the upper film 97 to the lower film 95 to form a drape or curtain. The film for the package is preferably of a barrier material laminated to a Surlyn (Trademark of E. I. DuPont) sealing surface. The initial seam 99 is made by pulling the free ends of the film through the seam sealing station 111 and actuating the seam seal system including upper and lower bars 125 and 113. The detailed operation of the seam sealing system as a portion of the packaging sequence is described hreinafter in the operation description.

Figure 7:
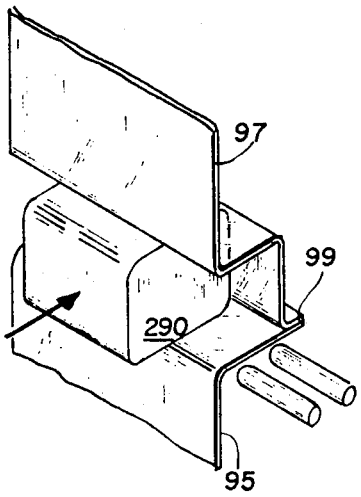
FIG. 7 through FIG. 15 represent isometric views, partly diagrammatic, of the product and film and the resulting stages of forming the package as found during several of the sequential operations performed by the apparatus.
Figure 9:
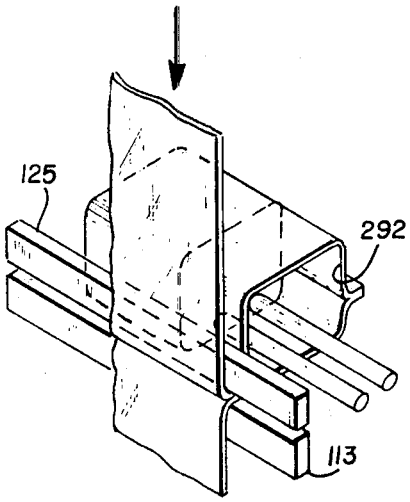

With the curtain of film formed by webs 95 and 97, the dancer arm cylinders 64 and 87 are relieved of pressurized air so that film 95 and 97 may be drawn from the film stored with the downward movement of the dancer arms 60 and 83. Product 290, as seen in FIGS. 2 and 7, is placed on the product support 101 between the curtain of film and the product pusher 105. Cylinder 109 is energized to move the pusher and the product 290 into the curtain of film. The advance of the product is stopped by a signal device, not shown, so that the trailing edge of the product is at a predetermined point which is ahead of the forward bars 113 and 125 of the sealing station. When and after the product is moved to this sealing position, the upper seal bar cylinder 131 is pressurized for downward movement carrying the upper seal bar 125 downward and with lower seal bar 113 seals the film 95 and 97 to form a new seam 99 and seal the film into a tube around the product. Pressure pad 135 clamps the film and product during the forming of a film wrapped product, identified as 291. As seen in FIG. 2, this close fitting sleeve completely envelopes the product 290 and, as seen in FIG. 9, has package mouths 292.

The upper seal bars 125 have their sealing strips 126 heated at this point. The heating ribbons may be impulse resistant ribbons. During the seam forming operation the knife 115 is moved upwardly by the cylinder 121 cutting the film between the pair of seams 99 made during the sealing operation. With film 97 and 95 clamped by seal bars 125 and 113 the upper film feed system 75 and cylinder 87 are energized to cause the dancer arm 83 to move downward. Film is pulled from the supply roll 77 by the downward movement of roller 85 until the dancer arm 83 reaches a limit stop 84 which may be adjustably positioned. Lower film feed system 51 is actuated at the same time and in the same manner to cause a determined supply of film to be drawn from the roll 52 by the downward movement of dancer arm 60 and roller 62.

Figure 8:
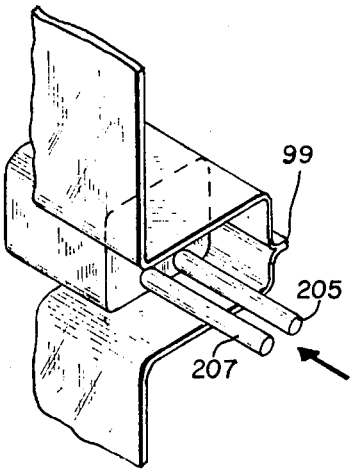

Prior to the actuation of the upper seal bar cylinder 131 a jet of air may be fed through the nozzles 103 to maintain the edge of the film in an open U-shaped condition for easy entry of the spreader probes 205 and 207. This entry of the probes is seen in FIG. 8 wherein these probes are shown as entering the film before forming into the package 291.

In certain packaging operations and in particular where the packaged product is four or five inches in width, the air blast has been supplanted with a mechanical finger or bar which is initially brought into engagement with the drape of the film to cause it to bow for placing the product in place. This bar or finger is withdrawn when the seal of FIG. 9 is achieved.

CENTRALIZING ACTUATION OF THE PROBES

Figure 18:
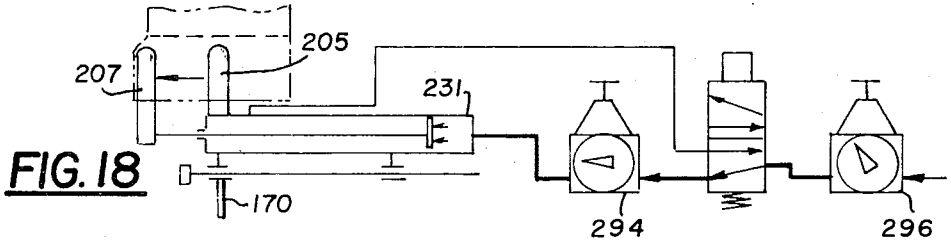
FIG. 18 represents the schematic view of the apparatus of FIG. 17 during the initial stages of spreader probe insertion into the film tube.
Figure 19:
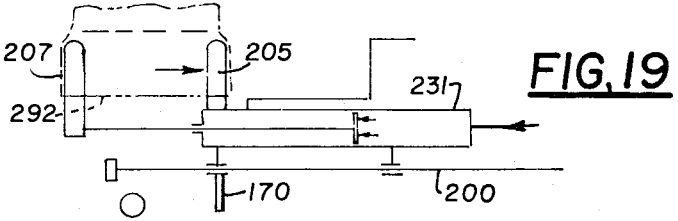
FIG. 19 represents the schematic view and apparatus of FIG. 18 with the probes moved into partial spreading condition.
Figure 20:
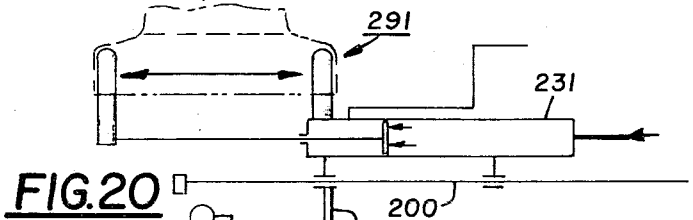
FIG. 20 represents the schematic view of the apparatus of FIG. 19 with the spreader probes fully and substantially equally spreading the end of a film tube under the influence of an equal pneumatic force.
Figure 21:
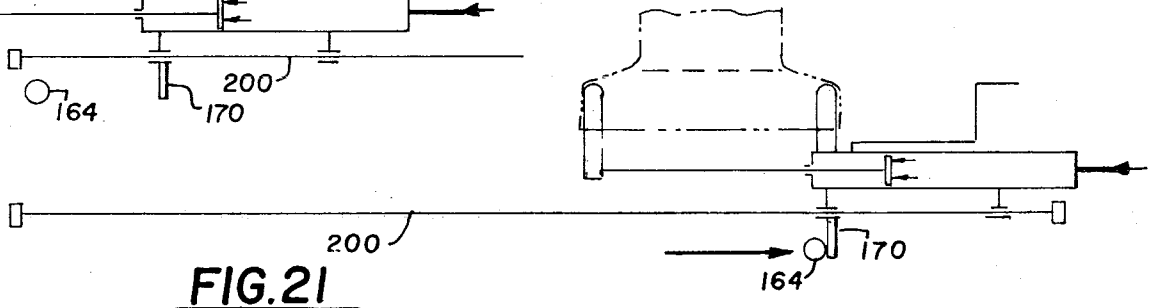
FIG. 21 represents the schematic view of the apparatus of FIG. 20 with the package and spreader probes transferred to the chamber position.

Referring to FIGS. 1 through 12 and FIGS. 16 through 21, it is to be noted that when the pneumatic cylinder 231 is energized the spreader probe 207 is urged forwardly against the left side of the package mouth 292. When the forward progress of the probe is resisted by the edge of the package mouth 292, as in FIGS. 10 and 18, the spreader probe 205 is urged rightwardly to engage the right edge of the package mouth 292, as shown in FIGS. 11 and 19, until the package mouth is completely spread, as shown in FIGS. 12 and 20. The antifriction movement of near member 172 and the opposite member along guide shafts, not shown, enable this simple and effective self-centering of the probes to occur. So as to not tear or destroy the seam 99 at the package mouth 292, the force and speed of impact of the spreader probes 205 and 207 are controlled by a secondary low pressure regulator 294 which is adjusted to accommodate the various types of film used for packaging. During this expanding and self-centering operation the spreader probes 205 and 207 are maintained in the inserted position and condition.

Figure 13:
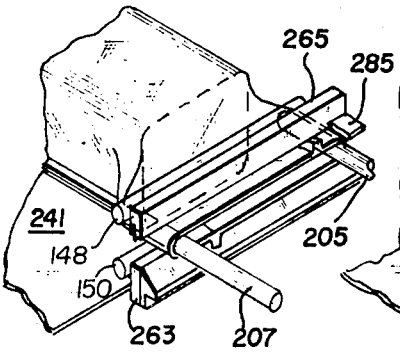

During the insertion and spreading of the probes in the end 292 of the package, the frame on which the probes are carried is relatively free to move in accordance with the developed resistance in the mouth of the package. After the package mouth has been fully spread, the transfer actuating cylinder 154 is energized causing the arm 160 to pivot. Reference is now particularly made to FIGS. 1 and 10. It is to be further noted that the position of cam track 166 will vary with the amount of relative motion between the spreader probe 205 and spreader probe 207 as a result of variations in package size. Since the opening of the cam track will not necessarily line up with the arc of the cam follower, 164 is carried on the arm 160, the hinged front member 168 of the cam track assembly 166 is provided. As the arm 160 is moved in an arc clockwise, the cam follower 164 approaches and then engages the inclined surface 169 of the front member 168 causing the front member to move inwardly against the bias of a spring, not shown, until the follower 164 enters the track 166 and engages the near member 170. With the follower 164 in the track, the further movement of the arm 160 causes the package and inserted probes to be transferred to the final seal station 255, as shown in FIGS. 2 and 13.

Figures 3A, 3B, 3C, 4A, 4B, 5A, 5B, 6A, 6B:
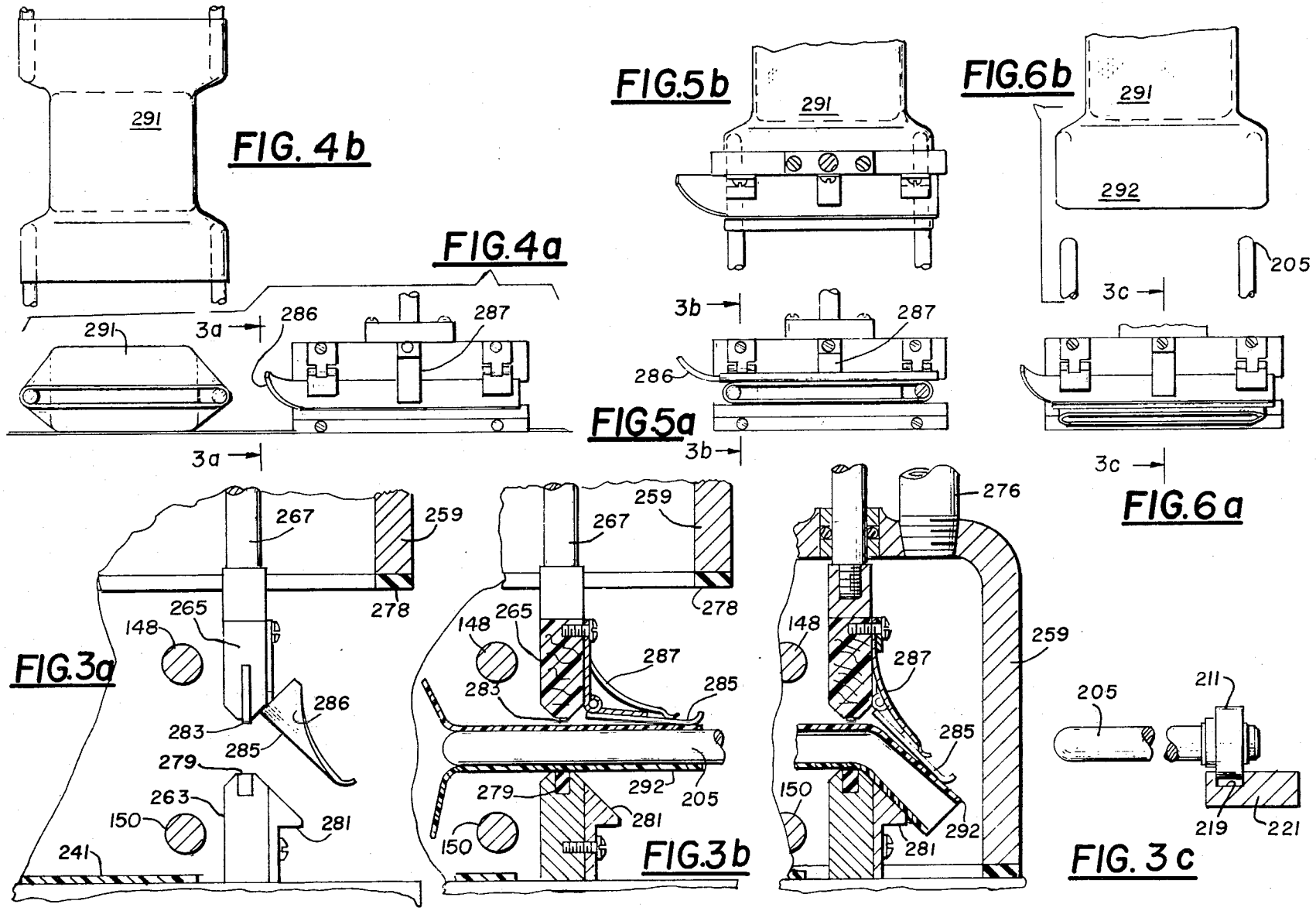
FIG. 3*a* represents in a slightly enlarged scale a sectional, fragmentary view of the vacuum chamber and seal bars prior to the presentation of a tubular film wrapped package and showing a local heating means adjacent the upper and lower bar portions.
FIG. 3*b* represents a sectional, fragmentary view of the vacuum chamber of FIG. 3*a* after a tubular wrapped package is positioned within the chamber and showing the spreader probes in place in the end of the package with a heating means adjacent the upper and lower film.
FIG. 3*c* represents a sectional, fragmentary view of the vacuum chamber of FIG. 3*a* but with the chamber in closed condition, the spreader probes moved from the package and outside the chamber but with the seal bar members in open condition and with both upper and lower seal bars shown with local heating element means.
FIG. 4*a* represents a somewhat diagrammatic side view of the package with a pair of spreader probes entered and moved apart in one end of the tubular film and adjacent thereto the seal bars for closing this elongated tubular opening.
FIG. 4*b* represents the plan view of the tubular film and product as shown in FIG. 4*a;*
FIG. 5*a* represents a side view of the seal bars of FIG. 4*a* as they are held apart for the slidable entry therebetween of the elongated open end of the tubular film and held apart by the spreader probes, this view taken prior to the clamping and sealing of the end of the film.
FIG. 5*b* represents a plan view of the package as wrapped and as shown in FIG. 5*a;*
FIG. 6*a* represents a side view, partly diagrammatic, with the spreader probes withdrawn and the seal bars as they close the stretched and warmed end of this package after evacuation and just prior to sealing the end of the tubular film.
FIG. 6*b* represents a plan view of the package as wrapped and as shown in FIG. 6*a,* this view showing the spreader probes retracted from the mouth of the tubular film.

In FIGS. 3*a* and 4*a* the chamber is shown in an open condition with the seal bars open and no package yet transferred therebetween. In FIG. 4*b* is seen the package 291 with the probes in both open ends of the film wrap. In FIGS. 3*b*, 5*a* and 5*b* the wrapped package 291 is shown as transferred to the sealing position with the probes 205 and 207 still in place. The package mouth 292 is now beteen the upper seal bar 265 and the lower seal bar 263. The gap between the upper seal bar 265 and the lower seal bar 263 is selected or established so that a clearance of approximately one-eighth of an inch is maintained over the thickness or diameter of the probes 205 and 207. As the spreader probe and mouth end 292 enter the space between the seal bars they engage the curved cam forward surface 286 of the hinged plow 285 and lift this plow upwardly to the position seen in FIG. 3*b* and also in the view of FIGS. 5*a* and 5*b*.

In FIGS. 3*a*, 3*b*, 3*c*, 3*d*, 3*e* and 3*f*, upper and lower heaters 148 and 150 are shown. Like heaters are used with the other end of the package and on the diametrically opposite side of the chamber. These may be locally positioned rod-like heating units.

Referring next to FIGS. 3*c*, 6*a*, 6*b* and FIG. 16, it is to be noted that the end of the transfer of the package the speader probes are removed and, as depicted in these views, as the probes are removed from the opening in the film wrap a release of the spreading force on the opening 292 occurs. These probes are moved toward each other by the release of the pressure in cylinder 231. The outward movement of the track 219 in member 221 pulls the roller 211, as seen in FIG. 3*c*, and the attached probe 205 out of the mouth of the film wrap and also from the chamber area. With the withdrawal of the probes, the plow 285 returns to its original biased down position in a spaced relationship to the mouth support member 281. The upper vacuum chamber 259 is now moved downwardly by the cylinder 257. With the chamber now closed and substantially sealed, the vacuum valve 271 is opened to a source of vacuum thereby reducing the pressure inside the chamber 295 and also in the sleeved package 291.

Figure 3F:
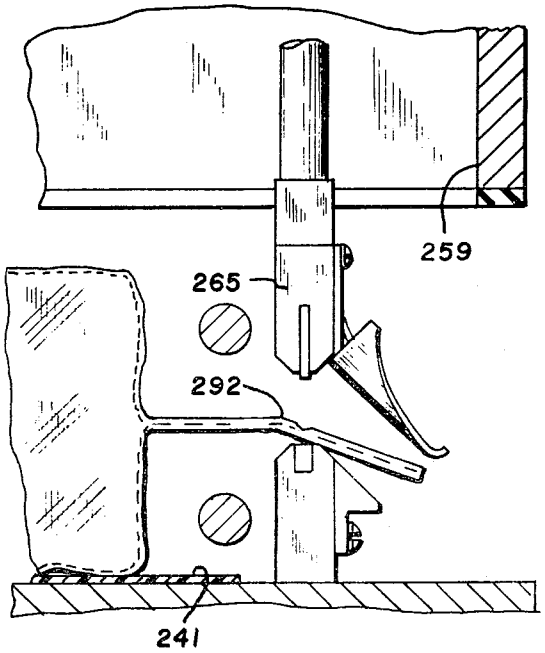
FIG. 3*f* represents a sectional, fragmentary view of the vacuum chamber of FIG. 3*e* after the venting of the chamber and with the upper chamber portion now raised to permit transfer and removal of the now completed package.
Figure 3E:
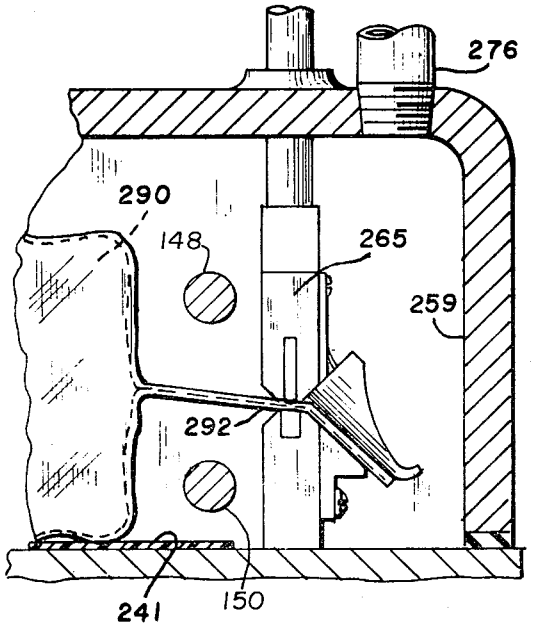
FIG. 3*e* represents the sectional, fragmentary view of the vacuum chamber of FIG. 3*d* after the venting of the chamber and with the seal bars shown in closed condition.
Figure 3D:
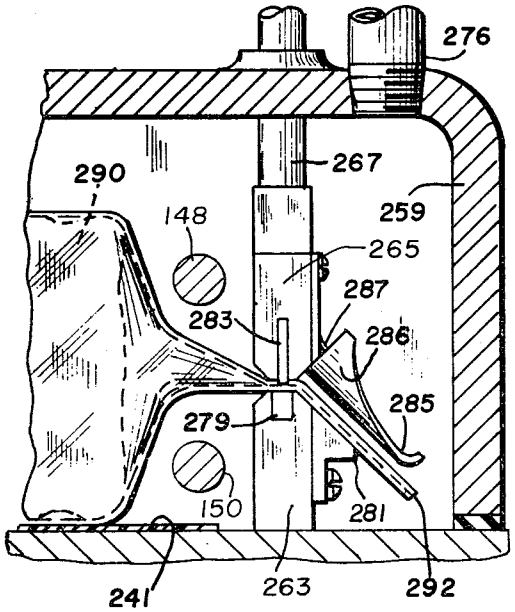
FIG. 3*d* represents a sectional, fragmentary view of the vacuum chamber and package of FIG. 3*c* after the chamber evacuation and showing the sealing of the elongated ends of the packages.
Figure 15:
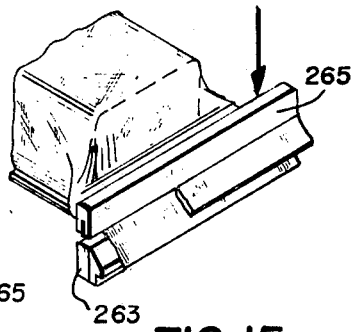

Reference is now made to FIG. 3*d* in which is depicted the closed chamber and when the pressure in the chamber and the package has been reduced to a desired level the upper seal bar 265 is urged downward by the actuated cylinder 269, as seen in FIG. 15. After the desired clamping pressure has been exerted, sealing means 283 is actuated effecting a sealing of the film layers at the package mouth 292. This sealing may be by an impulse or a hot bar. While the chamber is closing, the upper and lower heaters 148 and 150 warm the ends of the film.

After the seal has been made by the upper seal bar 265, the bar may be returned to its raised position by cylinder 269. The vacuum valve 271 is closed and the vent valve 275 is opened to the atmosphere and the seal bar is raised. This condition in the chamber is represented in FIG. 3*e*. The bar 265 is left in place during the vent cycle. After the venting cycle is completed, the vacuum chamber top 259 is raised, as seen in FIG. 3*f*. This venting cycle may include feeding warmed air through pipe or conduit 276. This warmed air is helpful in causing the film encasing the product to move tightly around the product and the sealing of adjoining webs to each other.

During the evacuation cycle the spreader probes 205 and 207 and their carriages 190 and 192 are returned to position 140, as shown in FIG. 1. At the end or near the end of this sequence of operation the cam follower 164 may exit the cam track 166. This occurs when the follower reaches the lower end of the front member 168. With the cam follower disengaged from the track 166 and carriage 190, the spreader probes 205 and 207 are free to center themselves in the package mouth 292 when the next spreading cycle begins. After the vacuum chamber is raised the conveyor belt 241 is moved by the drive means 247 and carries to the delivery conveyor 299 the complete package 300 which is packed for delivery in a normal manner.

The apparatus, above-described, in combination with the drawings show a package in which the film is formed into a tubular bag open at both ends and with the product placed therein. The ends are stretched to form mouth-like portions at each end of the tubular wrap. The probe members are self-centering and are required in their stretching force to accommodate the film being used. Whether the package is sealed under vacuum utilizing a hermetic seal or simply a flat seal for the package which is to be frozen or kept under refrigeration is merely a matter of selection. The package is formed with the elongated mouth portions enabling smooth seals to be made substantially without wrinkles. This is an essential part of this invention.

Figure 10:
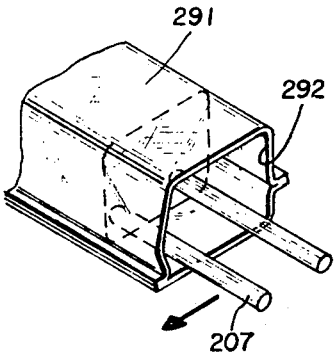
Figure 11:
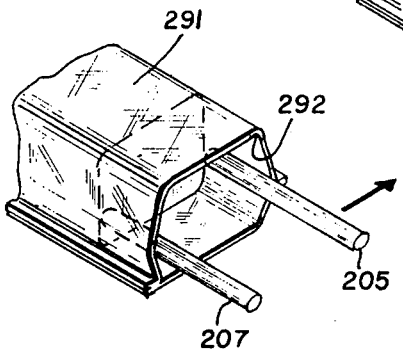
Figure 12:
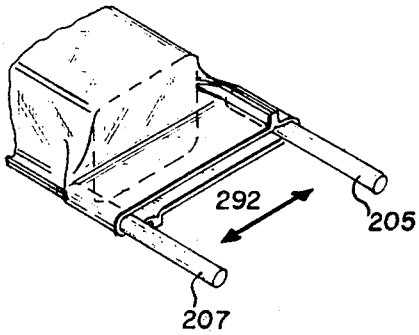
Figure 14:
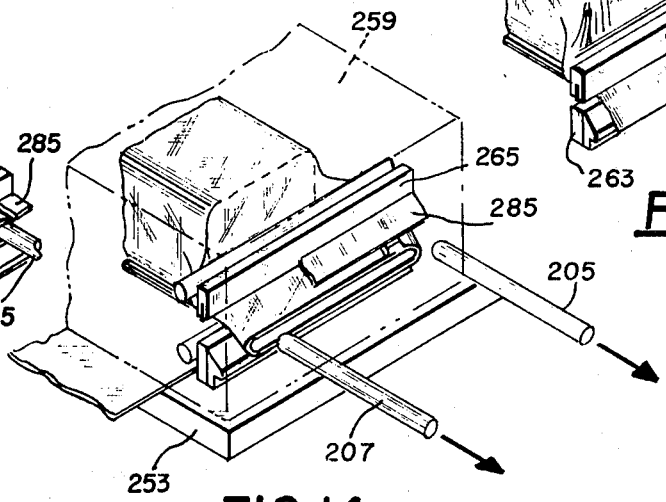

As a method the sequence is shown in the diagrammatic steps depicted in FIGS. 7 through 15. In FIG. 7, the film drape is provided and the product is advanced into the drape. In FIG. 8 the probes have been moved into the film end and adjacent the product prior to the sealing of the film drape, as shown in FIG. 9. After the seam is formed, the knife cuts the film and leaves a drape portion and the tubular film wrap, as seen in FIG. 10. It is to be noted that the seam may be mid-height of the package or at the bottom near the conveyor belt level. The right seam is shown near mid-height and the left seam is near the bottom of the package. The probe 207 approaches the left edge of the package mouth 292 and after engaging the film and meeting resistance the probe 205 moves rightward, as seen in FIG. 11, and under the influence of low pressure air in a cylinder 231 both probes move substantially equal distances from the theoretical center line of the package or tube of film. This is depicted in FIG. 12. With the probes still in stretching condition the enveloped product is advanced on belt 241 and by arm 160 to and between upper and lower seal bars 265 and 263, as shown in FIG. 13. In FIG. 14, the probes are withdrawn from the package mouth 292 and the chamber 259 is brought to a closed condition and subsequently preferably to a condition of reduced pressure. With or without the vacuum treatment the seal bars 265 and 263 are actuated to seal the end of the film, as seen in FIG. 15.

As a product the package includes a product of a size that is not conveniently wrapped by skin packaging. A tubular film preferably is formed around the product but could be cut-to-length tubular film with the product placed therein by entry through one end. After the product is placed within the tube the ends are entered by spreader probes which lightly stretch the film and form elongated narrow openings at each of the ends of the tubular film. The expansion pressure of the probes are removed and the probes are withdrawn from the entrance or mouth of the film wrap. The sealing means is immediately employed to close and seal each end of the tubular film.

It is also realized that the film could be a heat shrink film which would require a heat tunnel or the like. The film wrapped package shown and described above does not overstretch the film in its forming since regulators are available to move the cylinders which shape the package and seal the ends of the wrap.

Although FIG. 3*e* shows the clamp bar 265 in a closed or clamped position it is also to be noted that after sealing the clamp bar 265 may be raised before venting. The heated film if it has a sealant capability is sufficiently heated to stick to one another when the atmospheric pressure is let into the chamber. As stated above, the top web is bonded to the lower web under the influence of atmospheric pressure.

DIAGRAMS OF FIGS. 16-21

Referring next and finally to FIGS. 16 through 21, there is shown in FIG. 16 the timing diagram of the simultaneous movements provided in one cycle of operation. Particularly note is made of the upper seal bar 269 which remains in the closed condition during the venting of the chamber. FIGS. 17-21 show the actuation and control of the probes and the use of the regulator 294 and cylinder 231 to provide a self-centering regulated action with the close regulation by controlling the air pressure to the cylinder 231.

It is to be noted that the hinged plow 285 shown carried by the upper sealing means 265 is not needed with many films. Where the resulting seal causes the adjacent film to move more-or-less together the plow is not required. The plow merely insures that the resulting package is neat and the extending end portions result in a substantially overlaid relationship.

Terms such as "left", "right", "up", "down", "bottom", "top", "front", "back", "in", "out", "clockwise", "counterclockwise" and the like are applicable to the embodiments shown and described in conjunction with the drawings. These terms are merely for the purpose of description and do not necessarily apply to the position in which the method, product and apparatus may be constructed or used.

While a particular embodiment of the packaging apparatus has been shown and described it is to be understood the invention is not limited thereto since modifications may be made within the scope of the accompanying claims and protections is sought to the broadest extent the prior art allows.

What is claimed is:

1. A package apparatus for large products which have been irregular surfaces and voids, the apparatus utilizing a film which has sealing capabilities with said apparatus including: means for providing and delivering to a product enclosing station a tubular portion of film open at both ends; means for placing a product to be packaged in this tubular film with and while both ends of the film are in open condition; means for positioning oppositely disposed pairs of spreader probes so that each pair is in an open end of a tubular film, the pair of probes in a close together condition and to a position near the end of the product as placed in the tubular film, each pair of probes carried in a probe support means freely movable on a track and with entry of the spreader probes in this close together condition into the open end of the tubular film; means for disconnecting the probe support means so that the probes as carried by this means are free to move along the track; means for moving the spreader probes apart after entering the ends of the tubular film, the free movement of the probes allowing one probe to engage the inside of the tubular film whereupon the other probe beings movement to provide a self-centering in the tubular end of the film and to cause the ends of the film to be formed into narrow mouths, with these mouth openings and the spreader probes being substantially equal distant from the theoretical center line of the tubular film; means for limiting the apart movement of each pair of spreader probes so as to produce a controlled stretch and force to each of the tubular ends of the film; means for releasing the apart force on the probes and for withdrawing the spreader probes from the stretched elongated ends of the tubular film; means for sealing the elongated openings of the tubular film as and after the probes have been at least partially removed from the ends of the film, means for removing the now packaged product from the apparatus, the improvement in this apparatus including: means for heating that tubular film around the product as the film encased product and the probes in the ends thereof are transported from the product enclosing station to the sealing means.

2. A packaging apparatus as in claim 1 in which the means for heating the film as it is transported includes upper and lower heaters by which the encased film is heated before the film encased product is brought to said sealing means.

3. A packaging apparatus as in claim 1 in which the packaging is under the influence of vacuum and includes additional apparatus among which is means for transporting and placing the product and the inserted probes while in the tubular film within a selectively closable vacuum chamber and closing said chamber after the withdrawing of the probes from the ends of the tubular film, and there is provided heat sealing means for closing the ends of the tubular film, these ends of the film remaining open to the interior of the chamber while maintained between the heat sealing means and with the ends of the film free of wrinkles as the chamber and enclosed product is brought to a condition of reduced pressure, means for actuating the heat sealing means to seal the ends of the tubular film while the chamber is in a condition of reduced pressure and means for bringing the chamber to atmospheric pressure prior to the opening of the chamber and removal of the now heat sealed vacuum packaged product from the apparatus.

4. A packaging apparatus as in claim 3 in which there is provided in the chamber additional heating means in the form of local heaters disposed above and below the ends of the film so as to heat the film during its time in the chamber for evacuation, sealing and forming with the venting of the chamber.

5. A packaging apparatus as in claim 4 in which the venting of the chamber includes a heating means by which the incoming air delivered to the evacuated chamber is heated to a selected degree to soften the film and for pliability as it is pressed against and to the product.

6. A method for packaging large products which may have irregular surfaces and voids, the method utilizing a film which has sealing capabilities with said method including the steps of providing and delivering to a product enclosing station a tubular portion of film open at both ends; placing a product to be packaged in this tubular film with and while both ends of the film are in open condition; positioning oppositely disposed pairs of spreader probes so that each pair of probes enter an open end of a tubular film, the pair of probes in a close together condition and to a position near the ends of the product; carrying each pair of probes in a probe support freely movable on a track and with entry of the spreader probes in the close together condition into the open end of the tubular film; disconnecting the probe supports so the probes are free to move along the track; moving the speader probes apart after entering the ends of the tubular film, the free movement of the probes allowing one probe to engage the inside of the tubular film whereupon the other probe begins movement to provide a self-centering in the tubular end of the film and to cause the ends of the film to be formed into narrow mouths, with these mouth openings and the spreader probes being substantially equal distant from the theoretical center line of the tubular film; limiting the apart movement of each pair of spreader probes so as to produce a controlled stretch and force to each of the tubular ends of the film; releasing the apart force on the probes and withdrawing the spreader probes from the strtched elongated ends of the tubular film; sealing the elongated openings of the tubular film as and after the probes have been at least partially removed from the ends of the film; removing the now packaged product from the apparatus, the improvement further including the step of heating that tubular film around the product as the film encased product and the probes in the ends thereof are transported from the product enclosing station to the sealing of the ends.

7. The method of packaging large products as in claim 6 which includes the further step of arranging heaters above and below the film packaged product as it is transported from the enclosing station to the sealing of the ends.

8. The method of packaging large products as in claim 6 which includes the further step of transporting and placing the film encased product and stretched end openings with the apart probes therein in a selectively closable vacuum chambers and closing said chamber after withdrawing the spreader probes from the tubular film and maintaining the elongated narrow opening in the ends of the tubular film and further evacuating the closed chamber to bring the interior of the chamber and the package to a condition of reduced pressure and while in this condition actuating the heat sealing means to seal both ends of the tubular film and then the step of bringing the chamber to atmospheric pressure and opening the chamber and removing the now heat sealed vacuum packaged product.

9. The method of packaging large products as in claim 8 which includes the further step of providing additional heating means within the chamber, this heating being provided by local heaters disposed above and below the ends of the film so as to heat said ends during the time the package is in the chamber for evacuation, sealing and forming of the film by and with the venting of the chamber.

10. The method of packaging large products as in claim 9 which further includes the step of heating the air supplied to the venting inlet to the chamber, the delivered incoming air heated to a selected degree so as to soften the film for pliability and absence of wrinkles as the film is pressed to and against the product.

* * * * *